US009045269B2

(12) United States Patent
Frutin

(10) Patent No.: US 9,045,269 B2
(45) Date of Patent: Jun. 2, 2015

(54) CONTAINER CLOSURE HAVING MEANS FOR INTRODUCING AN ADDITIVE INTO THE CONTENTS OF THE CONTAINER

(75) Inventor: Bernard D. Frutin, Strathclyde (GB)

(73) Assignee: Gizmo Packaging Limited, Strathclyde (GB)

( * ) Notice: Subject to any disclaimer, the term of this patent is extended or adjusted under 35 U.S.C. 154(b) by 0 days.

(21) Appl. No.: 14/126,164

(22) PCT Filed: Jun. 13, 2012

(86) PCT No.: PCT/GB2012/051341

§ 371 (c)(1),
(2), (4) Date: Mar. 5, 2014

(87) PCT Pub. No.: WO2012/175934

PCT Pub. Date: Dec. 27, 2012

(65) Prior Publication Data

US 2014/0166510 A1 Jun. 19, 2014

(30) Foreign Application Priority Data

Jun. 24, 2011 (GB) ..... 1110722.4

(51) Int. Cl.
*B65D 83/00* (2006.01)
*B65D 51/28* (2006.01)
*B65B 69/00* (2006.01)

(52) U.S. Cl.
CPC ..... *B65D 83/00* (2013.01); *B65D 51/2864* (2013.01); *B65B 69/00* (2013.01)

(58) Field of Classification Search
CPC ..... B65D 51/2864
USPC ..... 206/221; 215/6, 316
See application file for complete search history.

(56) References Cited

U.S. PATENT DOCUMENTS

| | | | | |
|---|---|---|---|---|
| 6,843,368 | B1 * | 1/2005 | Frutin | 206/219 |
| 7,886,899 | B2 * | 2/2011 | Frutin | 206/221 |
| 2004/0200740 | A1 * | 10/2004 | Cho | 206/219 |
| 2009/0321286 | A1 * | 12/2009 | Frutin | 206/219 |
| 2010/0012532 | A1 * | 1/2010 | Frutin | 206/221 |

FOREIGN PATENT DOCUMENTS

| | | |
|---|---|---|
| WO | 2007117070 | 10/2007 |
| WO | 2007129116 | 11/2007 |
| WO | 2008023197 | 2/2008 |

OTHER PUBLICATIONS

Notification of Transmittal of the International Search Report and Written Opinion from EPO for PCT/GB2012/051341, dated Feb. 12, 2013, 7 pages.
Written Opinion for PCT/GB2012/051341, dated Feb. 12, 2013, 9 pages.

* cited by examiner

*Primary Examiner* — Steven A. Reynolds
*Assistant Examiner* — King M Chu
(74) *Attorney, Agent, or Firm* — Drinker Biddle & Reath LLP

(57) ABSTRACT

A closure device for releasing an additive liquid into a liquid in a container by operation of the closure device and to a container including such a closure device. The closure device including a cap member defining a fluid chamber having a neck at a lower end thereof and a casing substantially surrounding the fluid chamber. A plug member extends into the neck of the fluid chamber. The neck has an upper portion with a first diameter, and wherein the plug member comprises a primary seal adapted to seal between the plug member and the upper portion of the neck. An upper seal is adapted to seal between the plug member and the upper portion of the neck. A nozzle is directed away from the fluid chamber and in fluid communication with the exterior surface of the plug member below the primary circumferential seal.

15 Claims, 6 Drawing Sheets

CONTAINER CLOSURE HAVING MEANS FOR INTRODUCING AN ADDITIVE INTO THE CONTENTS OF THE CONTAINER

FIELD OF THE INVENTION

The present invention relates to a closure device for releasing an additive liquid into a liquid in a container by operation of the closure device and to a container including such a closure device. The invention also relates to a method of assembling a closure device and a method of introducing an additive liquid by means of operating a closure device.

BACKGROUND

In a number of applications, such as mixtures of different liquids, it may be necessary to release and mix an additive powder, gel or liquid into another liquid shortly before the liquid mixture is used. It may not be possible or desirable to store the products in a premixed form, as they may react undesirably with each other when stored as the mixture for a period of time. An example of this may be two component pharmaceuticals which have a longer shelf life when unmixed than they do when mixed. However, it can also apply to other liquids or to mixtures of liquids and gases, such as water, alcoholic beverages, other beverages, and other solvents or solutions. The liquid to which the additive liquid is introduced may be a carbonated or a non-carbonated liquid.

A closure device for releasing an additive liquid into a liquid in a container by operation of the closure device is known from the prior art. International Patent Application WO2007/129116 discloses a closure device for use with a container having a main liquid compartment and an opening with a neck. The closure device has a cap member defining a fluid chamber and a housing having a plug member. The plug member seals an aperture in the bottom wall of the fluid chamber. The plug member includes a nozzle directed away from the fluid chamber. When the cap member is turned it is lifted relative to the housing from a closed position in which the plug member closes the aperture to an open position in which the plug member is withdrawn from the aperture and provides a communication path for fluid in the fluid chamber to pass through the nozzle to the main liquid compartment.

The prior art closure device requires a separately formed bottom wall of the closure, since the portion surrounding the aperture in the bottom wall must be of a relatively flexible material to provide an effective seal with the plug member. This can increase the complexity of manufacture.

The prior art closure device requires a seal between the housing and the neck of the bottle, and an additional seal between the housing and the fluid chamber, to maintain pressure inside the main liquid compartment when the container is used with a carbonated beverage.

Once the prior art closure device is removed from the neck of the container, the liquid in the fluid chamber of the cap member can drip from the nozzle, since the cap member remains in its open position.

SUMMARY OF THE INVENTION

According to a first aspect of the present invention there is provided a closure device for releasing an additive liquid into a container by operation of the closure device, the container having a main liquid compartment and a container neck with an opening, the closure device comprising a cap member defining a fluid chamber having a neck at a lower end thereof and a casing substantially surrounding the fluid chamber and having a plug member extending into the neck of the fluid chamber, wherein the neck has an upper portion having a first diameter, wherein the plug member comprises a primary circumferential seal adapted to seal between the plug member and the upper portion of the neck, an upper circumferential seal adapted to seal between the plug member and the upper portion of the neck, and a nozzle directed away from the fluid chamber and in fluid communication with the exterior surface of the plug member below the primary circumferential seal, wherein the cap member is arranged to be lifted relative to the casing from a closed position, through an open position in which a communication path is provided from the fluid chamber through a path between the upper portion of the neck and the plug member to the nozzle, to a sealed position, wherein in the closed position the primary circumferential seal seals between the plug member and the upper portion of the neck, wherein in the open position the primary circumferential seal is located below the upper portion of the neck and the upper circumferential seal is located below the upper portion of the neck, and wherein in the sealed position the upper circumferential seal seals between the plug member and the upper portion of the neck.

The cap member and the casing may comprise mutually engaging detent means or locking means which engage when the cap member is lifted relative to the casing to the sealed position to prevent further relative movement of the cap member and casing.

The cap member may be provided with a primary engagement means which engages with a corresponding primary engagement means provided on the casing to allow the cap member to be lifted relative to the casing by relative rotation from the closed position through the open position to the sealed position.

The neck may comprise a lower cylindrical portion having a uniform diameter larger than the first diameter of the upper portion.

The plug member may comprise a secondary circumferential seal adapted to seal between the plug member and the lower portion of the neck.

The primary, secondary and upper circumferential seals may comprise O-rings, and may fit in grooves provided on the external surface of the plug member.

The primary, secondary and upper circumferential seals may comprise circumferential formations on the external surface of the plug member, such as sealing ribs.

According to a second aspect of the present invention there is provided a closure device for releasing an additive liquid into a container by operation of the closure device, the container having a main liquid compartment and a container neck with an opening, the closure device comprising a cap member defining a fluid chamber having a neck at a lower end thereof and a casing substantially surrounding the fluid chamber and having a plug member extending into the neck of the fluid chamber, wherein the neck has an upper portion having a first diameter and a lower cylindrical portion having a uniform diameter larger than the first diameter, wherein the plug member comprises a primary circumferential seal adapted to seal between the plug member and the upper portion of the neck, a secondary circumferential seal adapted to seal between the plug member and the lower portion of the neck, and a nozzle directed away from the fluid chamber and in fluid communication with the exterior surface of the plug member between the primary and secondary circumferential seals, wherein the cap member is arranged to be lifted relative to the casing from a closed position to an open position in which a communication path is provided from the fluid chamber through a path between the upper portion of the neck and the plug member to the nozzle, wherein in the closed position the primary circumferential seal seals between the plug member and the upper portion of the neck and the secondary circumferential seal seals between the plug member and the lower portion of the neck, and wherein in the open position the primary circumferential seal is located below the upper portion of the neck and the secondary circumferential seal maintains a seal between the plug member and the lower portion of the neck.

The cap member may be provided with a primary engagement means which engages with a corresponding primary engagement means provided on the casing to allow the cap member to be lifted relative to the casing by relative rotation from the closed position to the open position.

The primary and secondary circumferential seals may comprise O-rings, and may fit in grooves provided on the external surface of the plug member.

The primary and secondary circumferential seals may comprise circumferential formations on the external surface of the plug member, such as sealing ribs.

According to a third aspect of the present invention there is provided a closure device for releasing an additive liquid into a container by operation of the closure device, the container having a main liquid compartment for holding carbonated liquid and a container neck with an opening, the closure device comprising a cap member defining a fluid chamber having a neck at a lower end thereof and a casing substantially surrounding the fluid chamber and having a plug member extending into the neck of the fluid chamber, wherein the neck has an upper portion and a lower portion, wherein the closure device includes a primary seal adapted to seal between the plug member and the upper portion of the neck, and a secondary seal adapted to seal between the plug member and the lower portion of the neck, wherein the plug member includes a nozzle directed away from the fluid chamber and in fluid communication with the exterior surface of the plug member between the primary and secondary seals, wherein the cap member is arranged to be lifted relative to the casing from a closed position in which the primary seal seals between the plug member and the upper portion of the neck, through an intermediate position in which the primary seal continues to seal between the plug member and the upper portion of the neck, to an open position in which the primary seal does not seal between the plug member and the upper portion of the neck and a communication path is provided from the fluid chamber through a path along the upper portion of the neck to the nozzle, wherein the casing and the fluid chamber define an annular casing chamber there between, wherein the casing has a bottom wall provided with a vent and a secondary closure which is sealingly engageable with the neck of the cap member, such that in the closed position the secondary closure is sealingly engaged with the neck of the cap member and in the intermediate position the secondary closure is at least partially disengaged from the neck of the cap member to provide a communication path between the main liquid compartment through the vent to the casing chamber.

The cap member may be provided with a primary engagement means which engages with a corresponding primary engagement means provided on the casing to allow the cap member to be lifted relative to the casing by relative rotation from the closed position through the intermediate position to the open position.

In the open position the primary engagement means may provide a communication path for the passage of gas from the casing chamber along the communication path between the casing and the cap member to the exterior of the closure member.

The primary and secondary seals may comprise O-rings, and may fit in grooves provided on the external surface of the plug member.

The primary and secondary seals may comprise circumferential formations on the external surface of the plug member, such as sealing ribs.

The secondary closure may be a cylindrical upstand adapted to engage with the neck of the cap member. The closure device may include a lower seal provided on one of the upstand and the neck of the cap member adapted to seal with the other of the upstand and the neck of the cap member.

The lower seal may comprise an O-ring, and may fit in a groove provided on a surface of one of the upstand and the neck of the cap member.

The primary and secondary seals may comprise circumferential formations on the external surface of the plug member, such as sealing ribs.

The following features may be incorporated into the closure device according to all three aspects of the closure device invention, namely the first aspect incorporating primary and secondary circumferential seals or 'O' rings, the second aspect incorporating a vent for carbonated liquids, and the third aspect incorporating an upper circumferential seal or 'O' ring for resealing the closure device.

The closure device may be assembled prior to fitting to a container. In use the closure device preferably includes an additive liquid for releasing into the main liquid compartment of the container. Preferably the fluid chamber is pressurised.

The term "additive liquid" in this specification encompasses additives which flow in a manner similar to a liquid, such as an additive gel, or a free-flowing additive powder, or a solid additive in suspension in a liquid or gel. The additive liquid may comprise a pharmaceutical component, an ingredient, a colouring agent, a flavouring agent, or any other additive liquid.

The casing may include an inner casing wall adapted to fit inside the container neck of the opening and the closure device may include sealing means which seals between the container neck and the inner casing wall. This maintains a seal to hold the liquid and headspace gas in the main liquid compartment, whether the liquid is pressurised or unpressurised. The contents of the fluid chamber can thus pass into the main liquid compartment and be mixed, for example by shaking the container, without risk of the contents escaping between the container neck and the closure member.

In a preferred embodiment the primary engagement means on the cap member includes an internal thread and the primary engagement means on the casing includes an external thread so that the cap member is lifted relative to the casing by rotation of the cap member. However other forms of primary engagement means are possible, for example a bayonet type engagement or a friction pull engagement or a longitudinal sliding engagement, or any other suitable form of engagement. The primary engagement means may prevent the cap member from becoming completely separated from each other.

The cap member may include a top cap wall, a bottom cap wall from which the neck extends, an outer cap wall on which is provided the internal thread and an inner cap wall extending from the top cap wall to the bottom cap wall and arranged inside the outer cap wall. The fluid chamber may be defined by the top cap wall, the inner cap wall and the bottom cap wall.

The fluid chamber may be formed separately from the remainder of the cap member, which may be formed as a single moulding.

The casing may comprise an outer casing wall on which is provided the external thread.

The outer casing wall may be provided with an internal secondary thread adapted in use to engage with an external secondary thread provided on a container neck of an opening of the container. Thus in use the outer casing wall may be screwed onto the outside of the container neck.

The plug member may be integrally formed with the casing. The plug member may be formed separately from the casing and may be secured to the bottom wall of the casing, for example by a one way interference fit with an aperture in the bottom wall. The plug member may include an internal fluid passage which extends to the outer surface of the plug member at a position between the primary seal and the secondary seal, the internal fluid passage being in communication with the nozzle.

The cap member may include an anti-tamper strip provided on the cap member to prevent rotation of the cap member relative to the casing without at least partial removal or breaking of the anti-tamper strip.

The casing may include a security device which prevents rotation of the cap member and casing relative to the neck of the container until a predetermined torque is applied to the cap member.

The fluid chamber may contain an additive liquid and a head space of pressurised gas.

According to a fourth aspect of the present invention there is provided a container having a main liquid compartment, a container neck, an opening at the container neck and a closure device closing said opening, wherein the closure device comprises a closure device according the first, second or third aspects of the present invention.

The main liquid compartment may contain a primary liquid, which may contain water or be a beverage, and a headspace. However the primary liquid could be an alcoholic beverage, a cosmetic preparation, a pharmaceutical product, a dairy product or an agricultural feed or other product, or any other suitable liquid or semi-liquid substance. The headspace may be pressurised. The primary liquid may be a carbonated beverage.

The fluid chamber may contain an additive liquid and may contain a head space of pressurised gas.

The container neck may include an external secondary thread adapted to engage with the internal secondary thread on the outer casing wall.

The container may be of plastics material (e.g. PET) or of glass or of metal or of cardboard or a combination thereof.

According to a fifth aspect of the invention there is provided a method of introducing an additive liquid into a main liquid compartment of a container, the method comprising the steps of:

raising a cap member of a closure device and a pressurised fluid chamber defined by said cap member relative to a casing to cause a plug member provided on said casing to move downwards relative to a neck provided at a lower end of the fluid chamber, from a closed position in which a primary circumferential seal seals between the plug member and an upper portion of the neck, to an open position in which the primary circumferential seal is located below the upper portion of the neck and an upper circumferential seal is located above the upper portion of the neck;

releasing pressurised additive liquid from said fluid chamber along a communication path through the upper portion of the neck, through an internal fluid passage in the plug member which extends to the outer surface of the plug member at a position between the primary seal and the secondary seal, through a nozzle in communication with the internal fluid passage, and into said main liquid compartment; and raising the cap member further relative to the casing to a sealed position in which the primary circumferential seal is located below the upper portion of the neck and an upper circumferential seal seals between the plug member and the upper portion of the neck.

According to a sixth aspect of the invention there is provided a method of introducing an additive liquid into a main liquid compartment of a container, the method comprising the steps of:

raising a cap member of a closure device and a pressurised fluid chamber defined by said cap member relative to a casing to cause a plug member provided on said casing to move downwards relative to a neck provided at a lower end of the fluid chamber from a closed position in which a primary circumferential seal seals between the plug member and an upper portion of the neck and a secondary circumferential seal seals between the plug member and a lower portion of the neck, the lower portion having a uniform internal diameter larger than the diameter of the upper portion, to an open position in which the primary circumferential seal is located below the upper portion of the neck and the secondary circumferential seal maintains a seal between the plug member and the lower portion of the neck;

releasing pressurised additive liquid from said fluid chamber along a communication path through the upper portion of the neck, through an internal fluid passage in the plug member which extends to the outer surface of the plug member at a position between the primary seal and the secondary seal, through a nozzle in communication with the internal fluid passage, and into said main liquid compartment; and raising the cap member further to remove the cap member and casing from the container.

According to a seventh aspect of the invention there is provided a method of introducing an additive liquid into a main liquid compartment of a container, the method comprising the steps of:

raising a cap member of a closure device and a pressurised fluid chamber defined by said cap member relative to a casing to cause a plug member provided on said casing to move downwards relative to a neck provided at a lower end of the fluid chamber, from a closed position in which a primary circumferential seal seals between the plug member and an upper portion of the neck and a secondary circumferential seal seals between the plug member and a lower portion of the neck, and in which a secondary closure provided on the casing is sealingly engaged with the neck of the cap member to seal between the main liquid compartment and an annular casing chamber located between the casing and the fluid chamber, to an intermediate position in which the primary seal continues to seal between the plug member and the upper portion of the neck, and in which the secondary closure is at least partially disengaged from the neck of the cap member to provide a communication path between the main liquid compartment and the annular casing chamber, thereby allowing pressurised gas in the main liquid compartment to pass into the annular casing chamber and along a path between the cap member and the casing to atmosphere;

causing the plug member to move further relative to the neck to an open position in which the primary seal does not seal between the plug member and the upper portion of the neck;

releasing pressurised additive liquid from said fluid chamber along a communication path through the upper portion of the neck, through an internal fluid passage in the plug member which extends to the outer surface of the plug member at a position between the primary seal and the secondary seal, through a nozzle in communication with the internal fluid passage, and into said main liquid compartment; and raising the cap member further to remove the cap member and casing from the container.

The method may include the additional step of locking the cap member and the casing together in the sealed position to prevent further relative movement of the cap member and the casing. The locking may be through the engagement of mutually engaging detent means provided on the cap member and casing which engage when the cap member is lifted relative to the casing to the sealed position.

The method may include the additional step of raising the cap member further to remove the cap member and casing from the container.

The following features may be incorporated into the method according to all three aspects of the method invention, namely the fifth aspect which seals using primary and secondary circumferential seals or 'O' rings, the sixth aspect in which pressurised gas is vented to atmosphere in an intermediate position, and the seventh aspect which reseals in a sealed position using an upper circumferential seal or 'O' ring.

The cap member may be raised by rotating the cap member such that the fluid chamber is raised by screw thread action relative to the casing.

The cap member may be rotated by a first angle of between 0° and 90°, optimally about 45°, from the closed position to the open position. Further rotation of the cap member may be limited to a second angle of between 0° and 90°, optimally about 45°, by the mutual engagement of detent means provided on the cap member and casing. The second angle is predetermined by the position of the detent means. It is selected so that it is sufficient to ensure opening of the plug member and consequent mixing of the additive liquid, allowing for manufacturing tolerances.

The raising of said cap member relative to the casing may be achieved by engagement of an internal thread on the cap member with an external thread on the casing.

The internal thread may be provided on an outer cap wall of the cap member.

The fluid chamber may be defined by a top cap wall, a bottom wall and an inner cap wall extending from the top cap wall to the bottom wall and arranged inside the outer cap wall.

The external thread may be provided on the outer face of an outer casing wall.

The rotation of the cap member further to remove the cap member and casing from the container may be achieved by engagement of an internal secondary thread on the casing with an external secondary thread provided on a neck of an opening of the container.

The internal secondary thread may be provided on the inner face of the outer casing wall.

The inner cap wall may extend inside the neck of the container.

The casing may include an inner casing wall arranged inside the neck of the container, and provided with sealing means to seal between an outer surface of the inner casing wall and an internal surface of the neck of the container.

The method may further include the step of at least partially removing an anti-tamper strip provided at the outer cap wall, thereby allowing rotation of the cap member relative to the casing.

The method further may include the step of applying sufficient torque to the cap member, during the step of rotating the cap member further to remove the cap member and casing from the container, to break a security device.

BRIEF DESCRIPTION OF THE DRAWINGS

The invention will be described, by way of example only, with reference to the drawings in which.

DESCRIPTION OF THE PREFERRED EMBODIMENTS

Figure 1:
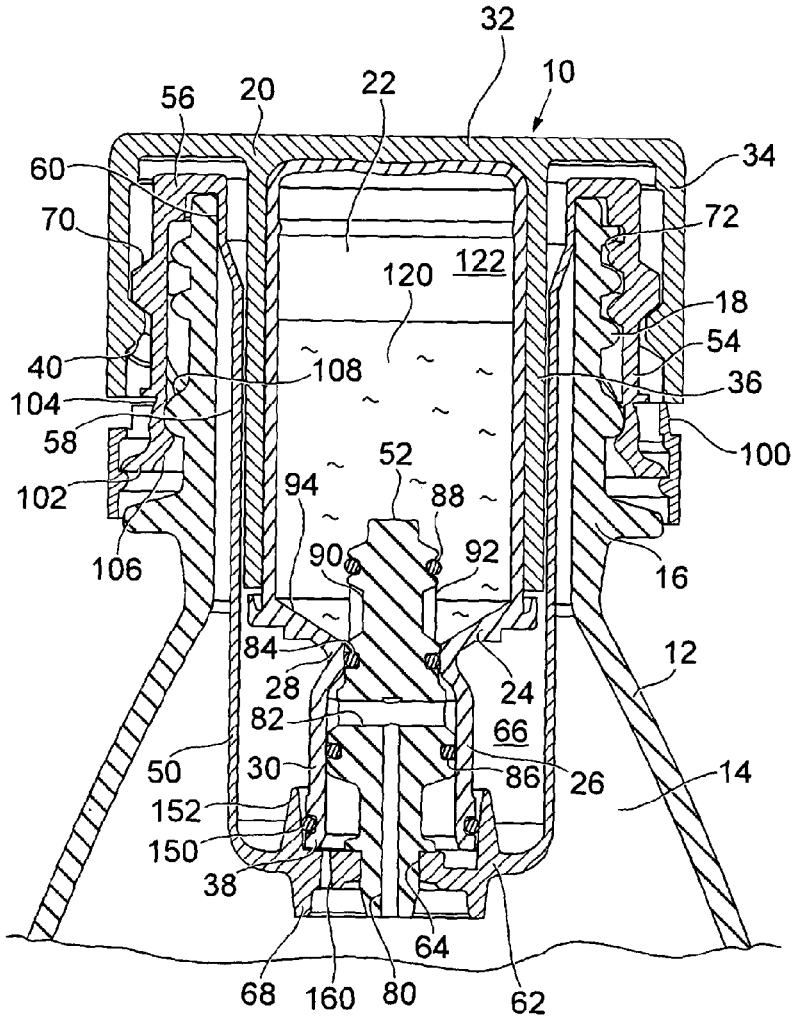
FIG. 1 is a cross-sectional view of a closure device according to the invention in a closed or storage position attached to the neck of a container.

With reference to FIGS. 1 to 5 there is shown a closure device 10. The closure device can be attached to a container 12, the upper part of which is shown in FIG. 1. The container is typically a standard PET bottle having a main liquid compartment 14 and a standard PCO 28 mm neck 16 with an external thread 18. For the purposes of this invention the thread is described as a secondary thread 18.

The closure device 10 comprises two main parts, a cap member 20, which defines a fluid chamber 22, and a casing 50. The cap member 20 includes a bottom wall 24 which opens to a neck 26. The neck includes an upper neck portion 28 of a first diameter and a lower neck portion 30 which has a uniform cylindrical inner surface of uniform second diameter, greater than the first diameter. Typically the first diameter may be between 3 and 7 mm, for example 5 mm, and the second diameter may be between 4 and 8 mm, for example 6 mm.

The cap member 20 includes a top cap wall 32, an outer cap wall 34, and an inner cap wall 36, which may all be formed as a single moulding from polypropylene or any other suitable plastic. In the illustrated example the fluid chamber 22 including the bottom wall 24 and neck 26 is formed as a first moulding which is inserted into a second separate moulding which includes the top cap wall 32, the outer cap wall 34 and the inner cap wall 36. However the cap member may be formed as a unitary moulding or by any other suitable means.

The outer cap wall 34 includes an internal primary thread 40 adapted to engage a corresponding external primary thread 70 on the casing 50, as will be described below. Together the internal and external primary threads 40, 70 form part of the primary engagement means which allow the cap member 20 to be lifted relative to the casing 50. The outer cap wall 28 may also include surface depressions (not shown) or any other suitable surface feature on the outer surface to aid gripping of the outer cap wall 28.

The casing 50 is also preferably formed as a polypropylene moulding, although it can be formed from any other suitable material. It comprises a plug member 52 arranged on the central axis of the closure member 10, an outer casing wall 54 adapted to fit outside the container neck 16, a flange 56 which sits on top of the container neck 16, an inner casing wall 58 which extends down from the flange 56 inside the neck and which seals against the container neck 16 with a seal, such as one or more sealing ribs 60, and a casing bottom wall 62 which supports the plug member. In the illustrated example the plug member 52 is formed as a separate moulding which is fitted to the casing by means of a one way interference fit in an aperture 64 in the casing bottom wall 62. The inner casing wall 58 and casing bottom wall 62 form an annular casing chamber 66 which surrounds the fluid chamber 22 of the cap member 20. When the cap member 20 is screwed down onto the casing 40, as shown in FIG. 1, the annular casing chamber 66 is separated from the main liquid compartment 14 by the seal 150, described below. In a variation in which there is no vent 160 in casing bottom wall 62, the annular casing chamber 66 is separated from the main liquid compartment 14 by the casing bottom wall 62.

The outer casing wall 54 has an external primary thread 70 which engages the internal primary thread 40 on the cap member 20 as part of the primary engagement means. It also has an internal secondary thread 72 which engages the external secondary thread 18 on the neck 16 of the container 12.

The plug member 52 has a nozzle 80 extending below it. A nozzle passage 82 is provided to convey pressurised liquid from the fluid chamber 22 when the closure device is opened. The plug member 52 is provided with three circumferential seals 84, 86, 88. These seals may be O-ring seals or they may be formed as ribs on the external surface of the plug member 52, provided that the plug member is of a material sufficiently resilient to function as a seal, or they may be any other suitable seals.

A circular rib 68 extends below the casing bottom wall 62. This serves to protect the protruding part of the nozzle 80 when the closure device is transported. Slits (not shown) may be provided in the rib 68 to prevent the formation of bubbles on the rib when gas is released from the nozzle 80.

If required a shaped cap (not shown) can be provided to span across the circular rib 68 and to connect to the bottom of the outer cap wall 34 to keep the interior of the closure device 10 clean or sterile. Alternatively the height of the casing 50 and cap member 230 can be selected such that the circular rib 68 does not project below the bottom of the outer cap wall 34, and a foil seal can be provided to span across the bottom of the outer cap wall 34 to keep the interior of the closure device 10 clean or sterile. The shaped cap or foil seal must be removed before the closure device is fixed to a container 12. This enables the closure device 10 to be supplied separately and to be installed by a user on their own container 12, for example to supply flavouring or other additive to the user's own bottled water.

A primary circumferential seal 84 is adapted to seal between the plug member 52 and the upper portion 28 of the neck 26. For this purpose the upper portion 28 must have a uniform first diameter over its length. A secondary circumferential seal 86 is adapted to seal between the plug member 52 and the lower portion 30 of the neck 26. The lower portion 28 is longer than the upper portion 26, and the secondary circumferential seal 86 continues to seal between the plug member 52 and the neck 26 over the full extent of travel of the plug member 52 within the neck 26, as described below.

An upper circumferential seal 88, which is the same size as the primary seal 84, is provided near the top of the plug member 52. It is adapted to seal between the plug member 52 and the upper portion 28 of the neck 26 when the closure device is in its sealed closed position. Between the primary and upper seals 84, 88 the plug member 52 has a reduced diameter core 90, which may also include longitudinal channels 92 to assist draining of liquid from the liquid chamber 22 when the primary seal 84 no longer seals the upper portion 28 of the neck 26 and the plug member 52 is in the open position. The upper surface 94 of the bottom wall 24 slopes towards the plug member 52, so that all the liquid is drained from the fluid chamber 22 when the plug member 52 is in the open position.

At the lower edge of the outer cap wall 34 is an anti-tamper strip 100, of the sort disclosed in WO2007/129116. However any known anti-tamper strip may be used. The purpose of the anti-tamper strip is to prevent the cap member 20 being unscrewed from the casing 50 by interaction of the internal primary thread 40 on the cap and the external primary thread 70 on the casing, until the anti-tamper strip 100 is at least partially removed.

At the lower edge of the outer casing wall 54 is provided a security ring 102 or other anti-tamper device. The ring 102 is an extension of the outer casing wall 54, connected by one or more neck portions 104, and includes a detent flange 106 which engages a corresponding detent means 108 provided on the container neck 16. Such security devices are known in the art and are not described further. A predetermined torque applied to the cap member 20 is required to break the neck portions 104 and allow the casing 50 to be raised on the secondary threads 18, 72 relative to the container neck 16. The security device 102 remains on the neck 16 of the container 12 below the detent 108. Any other suitable anti-tamper device may be used instead, or it may under certain circumstances be omitted.

The operation of the closure device of the invention will now be described with reference to FIGS. 1 to 5.

In FIG. 1 closure device 10 is secured to a container 12 containing a primary liquid (not shown), for example water, in its main liquid compartment 14. The fluid chamber 22 in the cap member contains a liquid additive 120 and a head space 122 of pressurised gas. The closure device 10 is in the closed position, in which the fluid chamber 22 is sealed closed by the primary circumferential seal 84, which seals between the upper neck portion 28 and the plug member 52.

The casing 50 is screwed fully onto the container neck 16 through the secondary threads 18, 72, and the cap member 20 is screwed fully onto the outer casing wall 54 through the internal and external primary threads 40, 70. The contents of the container 12 may be at atmospheric pressure, for example a still beverage, or may be pressurised, for example a carbonated beverage.

The seal 60 between the inner casing wall 58 and the container neck 16 ensures that the contents of the container are sealed from the external atmosphere.

When the primary liquid and headspace in the main liquid compartment 14 are pressurised, for example when the primary liquid is a carbonated beverage, the pressure in the main liquid compartment 14 must first be reduced, so that the pressure in the fluid chamber 22 is greater than the pressure in the main liquid compartment 14, ensuring subsequent successful firing of the liquid additive 120 into the main liquid compartment 14.

To permit the pressure reduction the lower end 38 of the neck 26 is provided with a lower circumferential seal 150 adapted to seal against a cylindrical upstand 152 provided on the casing bottom wall 62. The upstand 152 is a secondary closure which serves to seal closed the lower end 38 of the neck 26. The upstand 152 includes a number of longitudinal grooves 154 in the internal surface 156, best seen in FIG. 4, which extend from the top edge 158 of the upstand 152 to a point just above the position of the lower circumferential seal 150 when the closure is in its closed position shown in FIG. 1. The casing bottom wall 62 is also provided with a vent 160, for example a small diameter bore, which provides a gas communication path between the main liquid compartment 14 and the lower end 38 of the neck 26.

Although the drawings show the lower seal 150 provided on the outer surface of the neck 26, and sealing with the internal surface 156 of the upstand 152, it is to be understood that the upstand 152 could fit inside the lower end 38 of the neck 26, and the lower seal 150 could be provided on the inner surface of the neck 26 to seal with the external surface of the upstand 152.

Figure 2:
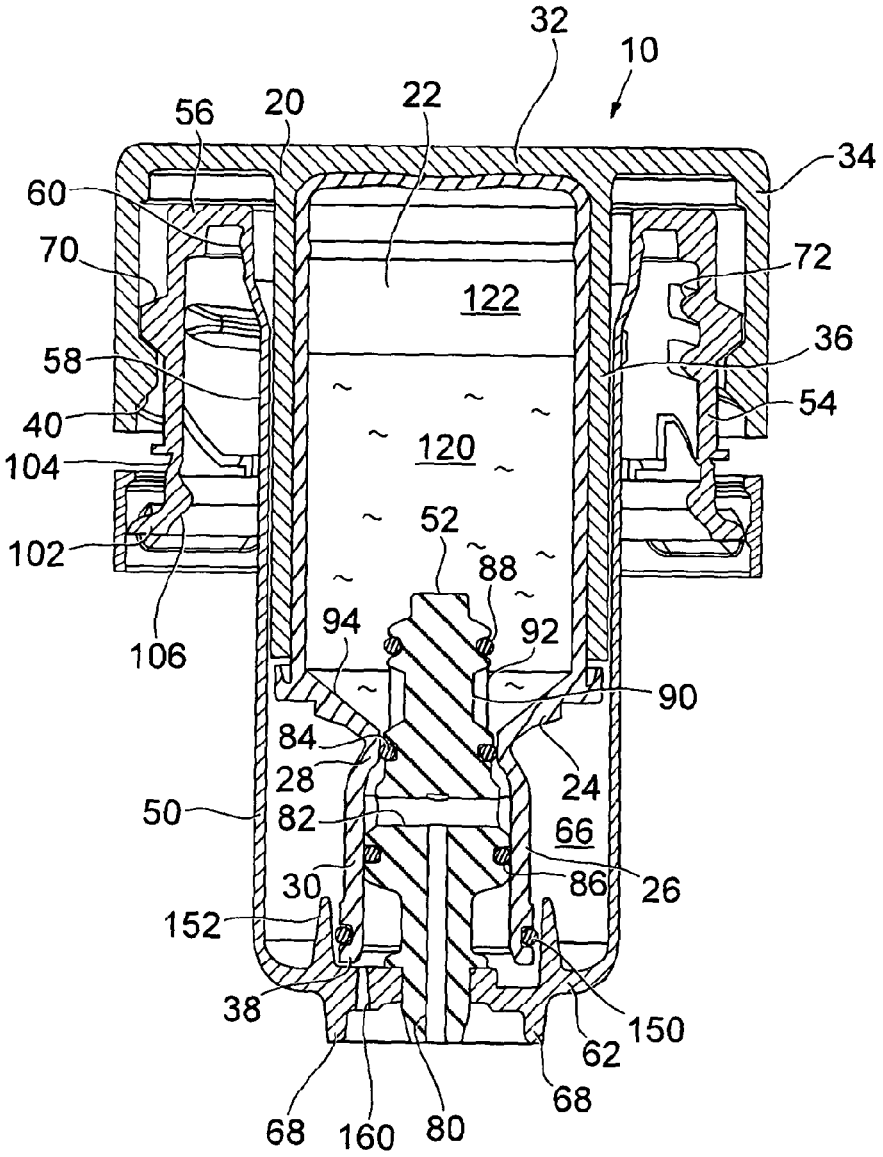
FIG. 2 is a cross-sectional view of the closure device of FIG. 1 in an intermediate position.

To reduce the pressure in the main liquid compartment 14, the cap member 20 must be unscrewed relative to the casing 50 to the intermediate position shown in FIG. 2, through an angle of just under 45° from the closed position according to a preferred embodiment. First the anti-tamper strip 100 is at least partially removed so that the outer cap wall 34 is free to be raised relative to the outer casing wall 54. Then the cap member 20 is grasped and rotated. As the cap member rises, the fluid chamber 22 is lifted relative to the plug member 52. The primary seal 84 moves to the bottom of the upper neck portion 28, where it continues to seal closed the neck 26. The lower seal 150 on the neck 26 moves upwards relative to the upstand 152 until it reaches the longitudinal grooves 154 in the internal surface 156 of the upstand 152. At this point a communication path is opened between the lower end 38 of the neck 26 and the annular casing chamber 66. Because the cap member 20 has been raised relative to the casing 50 there is no seal between the cap member 20 and casing 50, so there is a communication path opened between the annular casing chamber 66 through the primary threads 40, 70 to the exterior of the closure device. Hence gas can escape from the through the main liquid compartment 14 through the vent 160, past the lower seal and through the primary threads 40, 70 to atmosphere, so that the pressure in the main liquid compartment 14 reverts to atmospheric pressure.

If the primary liquid and headspace in the main liquid compartment 14 are not pressurised, this venting step is not necessary, and the lower seal 150, the vent 160 and the upstand 152 can all be omitted. However, for ease of manufacture the same closure device can be used with both pressurised and unpressurised main liquid compartments, and the lower seal 150 can simply be omitted when it is used with unpressurised main liquid compartments.

The arrangement of a lower seal 150 offers a number of advantages over the prior art. In particular it enables effective operation of the closure device 10 to add an additive liquid to a carbonated beverage r other pressurised liquid. It minimises the risk of liquid being expelled between the container neck 16 and the closure device 10 when the closure device is unscrewed.

The fluid chamber 22 can be formed as a single piece. Instead of having to form the bottom wall of a softer material to ensure a seal with the plug member, relocating the seal from the bottom wall 24 to the plug member 52 allows the fluid chamber 22 to be made of a single, relatively stiff moulded material, thereby reducing the cost and complexity of the closure device 10. Since all the components of the closure device, apart from the O-ring seals 84, 86, can be made from the same material, recyclability is improved. The neck 26 is rigid and can be manufactured to a high tolerance, as can the plug member 52, so the reliability of the operation of the seals 84, 86 is improved.

Figure 3:
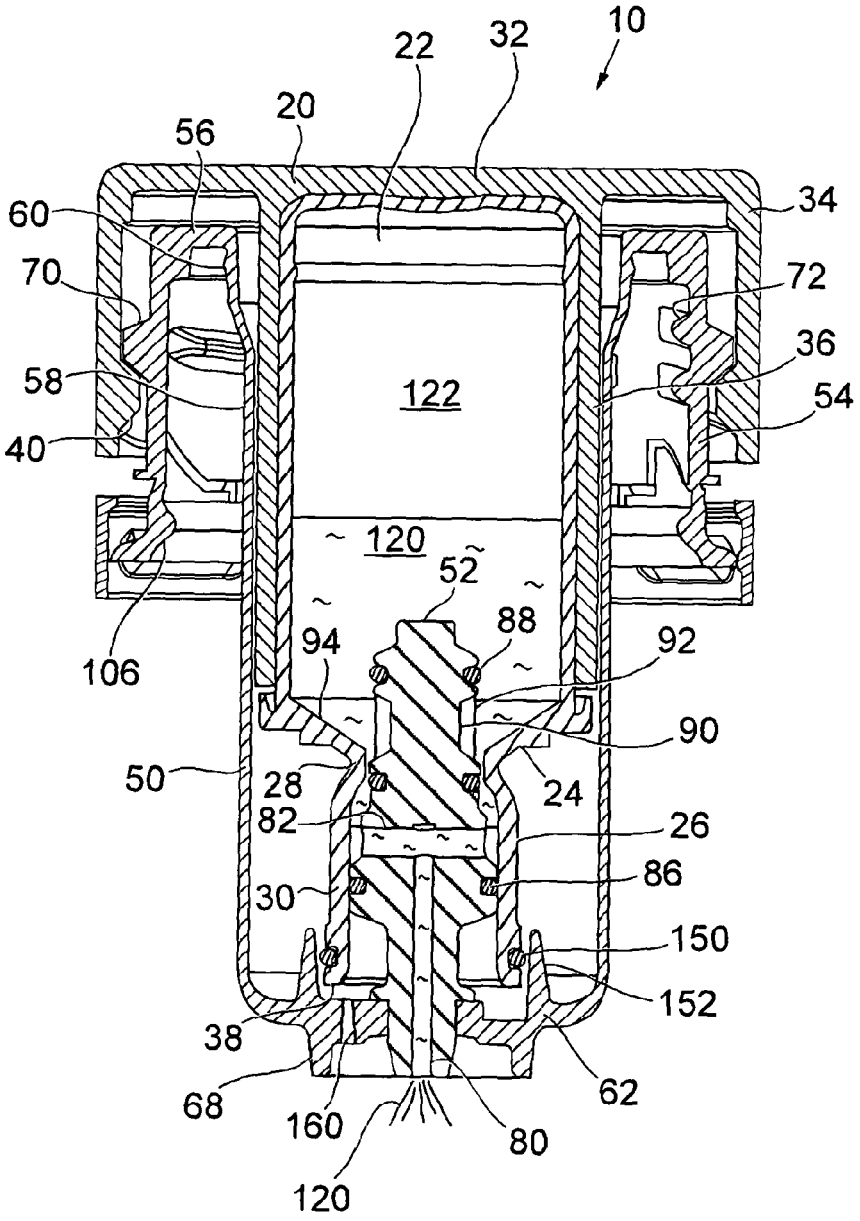
FIG. 3 is a cross-sectional view of the closure device of FIG. 1 in an open position.

To trigger the firing of the liquid additive 120 into the main liquid compartment 14 of the container 12, the cap member 20 must be unscrewed relative to the casing 50 to the open position shown in FIG. 3, through a first angle of just over 45° from the closed position according to a preferred embodiment. However it is to be understood that this first angle may be any desired angle by appropriate selection of the dimensions and pitch of the primary threads 40, 70.

If the lower seal 150 is omitted, the pressure reducing step illustrated in FIG. 2 is not necessary. Starting from the position shown in FIG. 1, the anti-tamper strip 100 is at least partially removed or broken so that the outer cap wall 34 is free to be raised relative to the outer casing wall 54. Then the cap member 20 is grasped and rotated. As the cap member rises, the fluid chamber 22 is lifted away from the plug member 42 and the cap member is moved to the position shown in FIG. 3.

If the lower seal 150 is included then the cap member 20 is rotated further beyond the intermediate position shown in FIG. 2 to the open position shown in FIG. 3.

When the primary seal 84 passes below the end of the upper neck portion 28, as shown in FIG. 3, the main liquid compartment 14 comes into fluid communication with the fluid chamber 22, and the pressurised additive liquid 120 is free to pass between the primary seal 84 and neck 26, into the internal fluid passage 82, and out of the nozzle 80 into the main liquid compartment 14. The secondary seal 86 continues to seal between the lower neck portion 30 and the plug member 52, so that the additive liquid 120 cannot leak into the main liquid compartment 14 along any other path. Although any suitable size thread may be used, typically the primary thread 40, 70 is a standard 28 mm PET bottle thread with 9 mm pitch, of the type used with PET water bottles, and the closure device 10 is arranged so that the additive liquid 120 is fired into the main liquid compartment 14 when the cap member is rotated through approximately 45° from the closed position under optimum tolerance. In practice this angle could be smaller or greater, in the range 0° to 90°.

The volume of the head space 122 is chosen to be sufficiently large so that all the additive liquid 120 is expelled into the main liquid compartment 14. The upper surface 94 of the bottom wall 24 slopes down towards the upper neck portion 28, so that under gravity all the additive liquid flows to the aperture. The reduced diameter core 90 enters the upper neck portion 28 as the cap member 20 is turned further, thereby forming a large cross-section passage through which any remaining additive liquid 120 can drain.

The arrangement of the primary and secondary seals 84, 86 offers a number of advantages over the prior art.

The fluid chamber 22 can be formed as a single piece. Instead of having to form the bottom wall of a softer material to ensure a seal with the plug member, relocating the seal from the bottom wall 24 to the plug member 52 allows the fluid chamber 22 to be made of a single, relatively stiff moulded material, thereby reducing the cost and complexity of the closure device 10. Since all the components of the closure device, apart from the O-ring seals 84, 86, can be made from the same material, recyclability is improved. The neck 26 is rigid and can be manufactured to a high tolerance, as can the plug member 52, so the reliability of the operation of the seals 84, 86 is improved.

Figure 4:
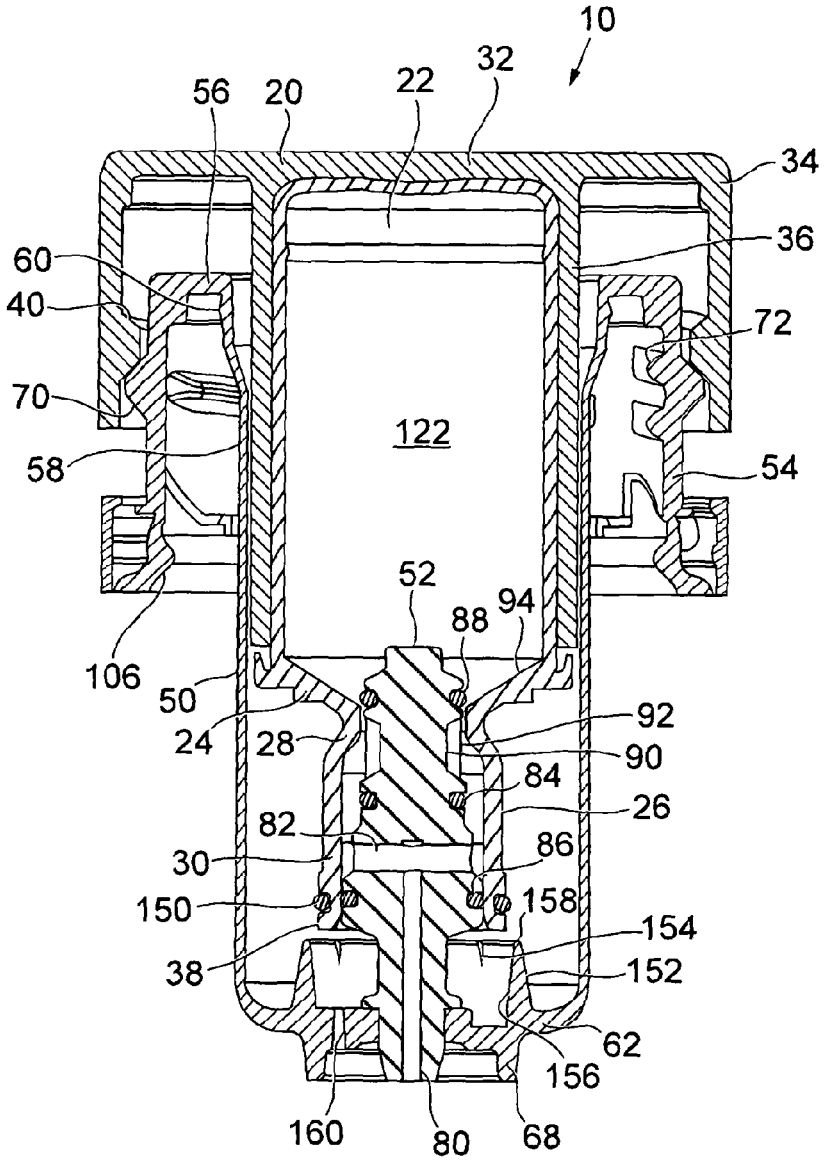
FIG. 4 is a cross-sectional view of the closure device of FIG. 1 in a further open position.

Following the firing of the additive liquid 120 into the main liquid compartment 14, the cap member 20 is rotated further, through a further angle of approximately 45° according to a preferred embodiment, until the upper seal 88 on the plug member 52 approaches the upper neck portion 28 of the fluid chamber 22, as shown in FIG. 4. The secondary seal 86 continues to seal between the lower neck portion 30 and the plug member 52, so that any remaining additive liquid 120 cannot pass into the main liquid compartment 14 other than through the nozzle 80.

Figure 5:
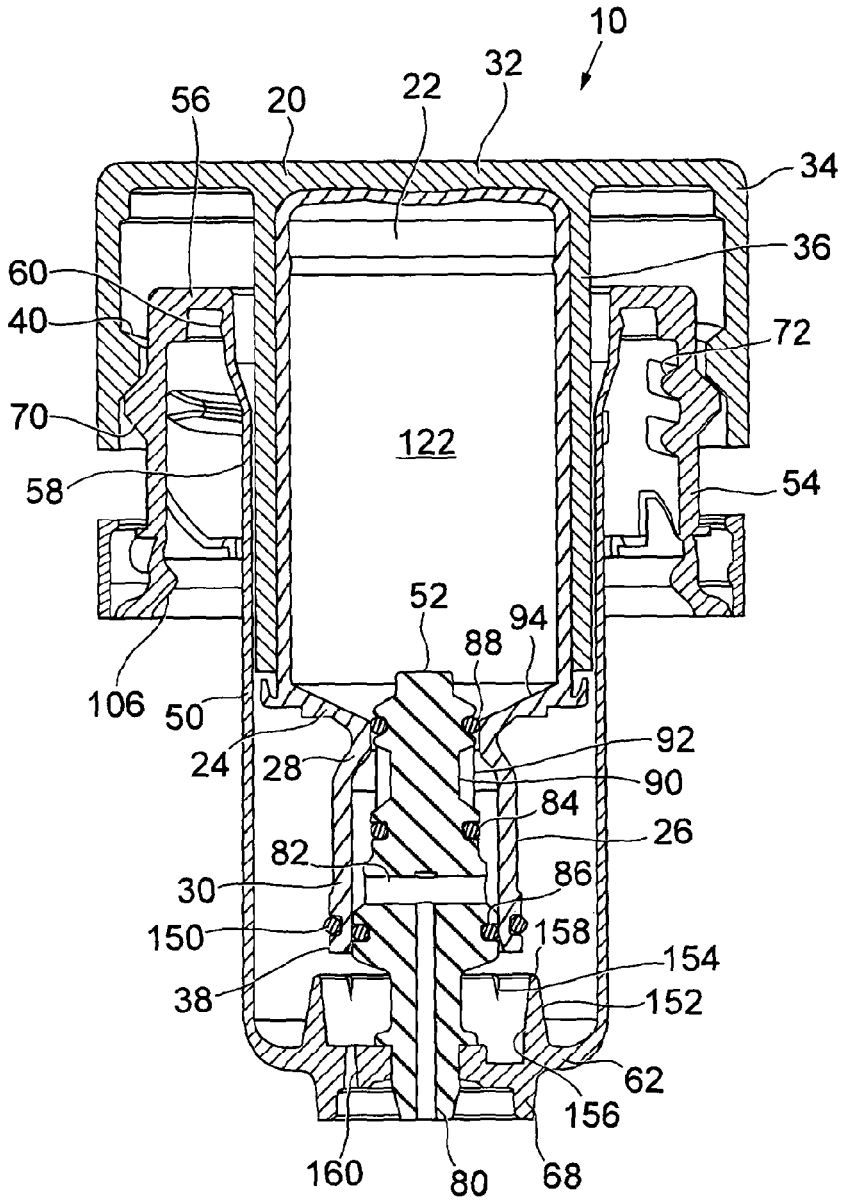
FIG. 5 is a cross-sectional view of the closure device of FIG. 1 in a sealed position.

Further rotation of the cap member 20 results in the upper seal 88 on the plug member 52 entering the upper neck portion 28 of the fluid chamber 22, and sealing between the plug member 52 and the upper neck portion 28. The closure device 10 is then in the sealed position as shown in FIG. 5. The secondary seal 86 continues to seal between the lower neck portion 30 and the plug member 52, so that any remaining additive liquid 120 in the annular space between the lower neck portion and the plug member 52 cannot leak out past the plug member 52. Any remaining liquid in the fluid chamber 22 is sealed in by the upper seal 88 and cannot escape. The nozzle 80 is of such a small diameter that any remaining liquid in the annular space between the lower neck portion 30 and the plug member 52 is held by an air lock and cannot escape through the nozzle 80.

Rotation of the cap member 20 just beyond the position shown in FIG. 5 results in locking means in the form of mutually engageable detent means 162 on the cap member 20 and casing 50 engaging with each other to prevent further relative rotation of the cap member 20 and casing 50 in either rotational direction. They are effectively locked together. At this point the torque on the cap member 20 is transferred to the outer casing wall 54 and the casing 50 begins to rotate relative to the container neck 16. In the illustrated embodiment a security or anti-tamper device 102 is provided on the casing 50, so an increased torque must be applied to first break the neck portions 104 of the security device 102 before the casing 50 can be raised relative to the container 12 by engagement of the secondary threads 18, 72. The secondary threads 18, 72 are typically MCA2 threads of 3.2 mm pitch. As the cap member 20 is rotated, the entire closure device 10 is lifted from the container 12, until it is removed from the container 12.

Figure 6:
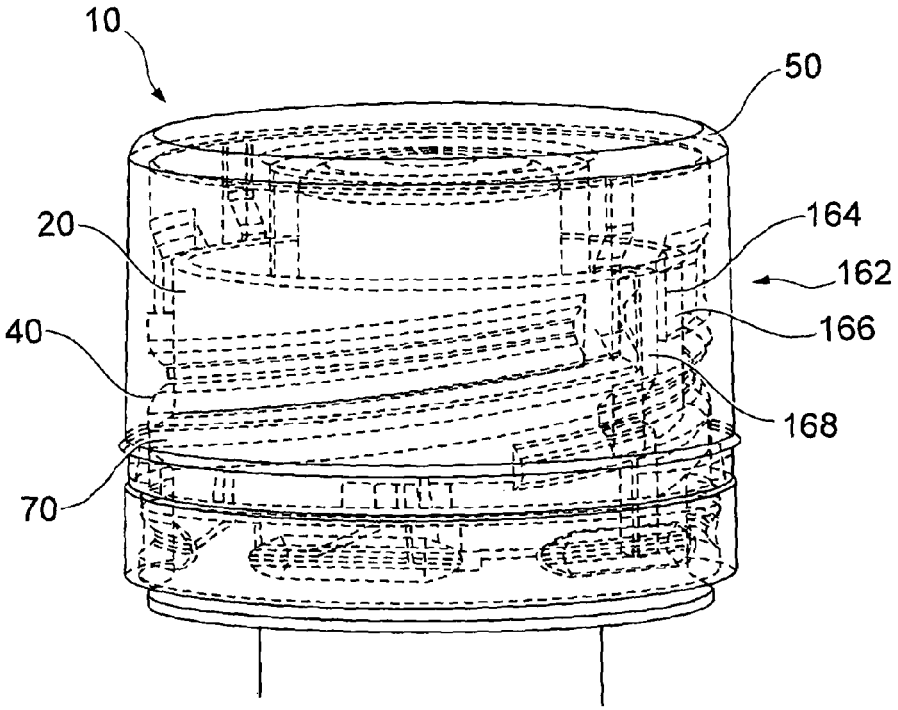
FIG. 6 is a perspective transparent view of the closure device of FIG. 1.

FIG. 6 shows detail of the detent means 162. The detent means 162 comprises cooperable formations at the extremities of both the internal primary thread 40 and external primary thread 70. An internal primary thread detent member 164 abridges the pitch of the internal primary thread 40, forming an obstruction, just prior to the termination of the internal primary thread 40 at its uppermost extent i.e. nearest the top cap wall 32. The internal primary thread 40 continues for a short distance after the internal primary thread detent member 164, forming an internal primary thread indent 166 adjacent the internal primary thread detent member 164.

A corresponding external primary thread member 168 extends upwardly from the uppermost extent of the external primary thread 70 i.e. nearest flange 56. The external primary thread member 70 extends longitudinally along the outer casing wall 54.

In use, as the cap member 20 is rotated as described above, the external primary thread member 168 eventually abuts the internal primary thread detent member 164. Further rotation of the cap member 20 causes a slight elastic deformation of the cap member 20 and casing 50, allowing the external primary thread member 168 to pass over the internal primary thread detent member 164, eventually leading to the external primary thread member 168 being seated within the internal primary thread indent 166. The interference fit caused by such seating mitigates further relative rotation of cap member 20 and casing 50.

If the lower seal 150 and vent 160 are omitted, then when the liquid additive 120 is fired into the main liquid compartment 14 in the open position shown in FIG. 3, the high pressure in the fluid chamber 22 is dissipated into the headspace of the main liquid compartment 14, so that both the fluid chamber 22 and the main liquid compartment 14 are at an intermediate pressure greater than atmospheric but substantially less than the original high pressure in the fluid chamber 22. When the casing 50 is raised relative to the container 12, thereby opening the container, the pressure in the main liquid compartment 14 drops to atmospheric pressure. The pressure in the annular space between the lower neck portion 30 and the plug member 52 also falls to atmospheric pressure, thereby ejecting any remaining additive liquid 120 in the nozzle 80 down into the main liquid compartment 14. However the pressure in the fluid chamber 22 remains at the intermediate pressure, since it is effectively sealed by the upper circumferential seal 88.

If required, the closure device 10 can be screwed back onto the container 12, to close the container. The cap member 20 and casing 50 remain locked together so that they cannot move relative to each other. This ensures that the fluid chamber 22 remains sealed by the upper circumferential seal 88, so there is no risk of additive liquid 120 leaking from the closure device 10.

The provision of the upper seal results in a number of advantages over the prior art. The closure device 10 can be safely removed from the container 12 without the risk of the contents dripping from the nozzle 80. The provision of a locking means to automatically lock the cap member 20 and casing 50 together when the cap member is rotated to open the closure means that the closure can safely be reused to reclose the container, without the risk of the upper seal 88 reopening and causing further firing of the closure device as a result of the intermediate residual pressure in the fluid chamber 22. Moreover the cap member 20 and casing 50 cannot be rotated relative to each other while the closure device 10 is removed from the container, thereby preventing accidental discharge from the closure device while the closure device 10 is not on the container 12.

The closure device 10 can be filled by any suitable method such as the method disclosed in WO2007/129116. Typically pressurised gas forms a head space 122 in the fluid chamber 22 of between 0% and 60% of the volume of the fluid chamber 22.

The closure device 10 can be used with any standard container 12, of any shape or volume, of any material, for example PET, glass, metal or any suitable plastic. The external secondary thread 18 on the neck 16 of the container 12 can be any standard thread.

The closure device optimises use of the volume within the neck 16 of the container 12, since the fluid chamber extends across the whole available area of the neck 16. The internal diameter of the fluid chamber 22 is limited only by the thickness of the inner casing wall 58 and the inner cap wall 36. The volume of the fluid chamber 22 may be varied by varying the length of the fluid chamber.

The materials of the closure device can be selected to avoid any compatibility problems with the liquid additive 120. During storage the liquid additive is only in contact with the fluid chamber 22 and the plug member 52. The plug member can be made separately from a different material to the remainder of the casing, if required. A liner, for example of stainless steel, can be used inside the fluid chamber to avoid contact with the moulded cap member 20, if required.

Modifications and variations are possible without departing from the scope of the invention. The primary threads 40, 70 may be of any suitable thread design, and arranged so that the closure device fires, that is ejects the liquid additive 120 into the main liquid compartment 14, after any suitable angle of rotation, for example 45° to 135°, and allows removal of the closure device from the container after any suitable further angle of rotation, for example 270° to 450°.

The provision of an upper seal 88 to permit resealing is not limited in application to a closure device which includes both primary and secondary seals 84, 86, as described herein, nor to a closure device which includes a secondary closure 152 and lower seal 150, as described herein, and may be used with other suitable closure devices, for example the closure device of WO 2007/129116.

The use of primary and secondary seals 84, 86 with a neck 26 having upper and lower portions 28, 30 of different diameter is not limited in application to a closure device which includes an upper seal 88 to permit resealing, as described herein, nor to a closure device which includes a secondary closure 152 and lower seal 150, as described herein, and may be used with other suitable closure devices, for example the closure device of WO 2007/129116.

The provision of a secondary closure 152 and lower seal 150 for use with carbonated liquids is not limited in application to a closure device which includes an upper seal 88 to permit resealing, as described herein, nor to a closure device which includes primary and secondary seals 84, 86 with a neck 26 having upper and lower portions 28, 30 of different diameter, as described herein, and may be used with other suitable closure devices, for example the closure device of WO 2007/129116.

Modifications and improvements can be made to the embodiments herein before described without departing from the scope of the invention. For example, although only one nozzle 80 is shown and it is directed directly downward, allowing the liquid additive 20 to be directed towards the fluid in the container, it will be appreciated that several nozzles may be employed or the nozzle(s) may be directed at an angle. For example, it may desirable that the liquid additive 120 is directed at the container neck 16 allowing a discrete layer of liquid additive 120 to be formed onto the upper surface of the liquid within the container.

ELEMENT LIST

10 closure device
12 container
14 main liquid compartment
16 container neck
18 container external thread (secondary thread)
20 cap member
22 fluid chamber
24 bottom wall
26 neck
28 upper neck portion
30 lower neck portion
32 top cap wall
34 outer cap wall
36 inner cap wall
38 lower end of neck 26
40 internal primary thread (on inner cap wall)
50 casing
52 plug member
54 outer casing wall
56 flange
58 inner casing wall
60 sealing ribs
62 casing bottom wall
64 aperture in casing bottom wall
66 annular casing chamber
68 circular rib
70 external primary thread (on casing)
72 internal secondary thread (on casing)
80 nozzle
82 nozzle passage
84 primary circumferential seal
86 secondary circumferential seal
88 upper circumferential seal
90 reduced diameter core (of plug member)
92 longitudinal channels (of plug member)
94 upper surface (of bottom wall 24)
100 anti-tamper strip
102 security device
104 neck portions
106 detent flange
108 detent means
120 liquid additive
122 head space (in fluid chamber 22)
150 lower circumferential seal
152 cylindrical upstand
154 longitudinal grooves
156 internal surface (of cylindrical upstand 152)
158 top edge (of upstand 152)
160 vent
162 detent means
164 internal primary thread detent member
166 internal primary thread indent
168 external primary thread member

The invention claimed is:

1. A closure device for releasing an additive liquid into a container by operation of the closure device, the container having a main liquid compartment and a container neck with an opening, the closure device comprising a cap member defining a fluid chamber having a neck at a lower end thereof and a casing substantially surrounding the fluid chamber and having a plug member extending into the neck of the fluid chamber, wherein the neck has an upper portion having a first diameter, wherein the plug member comprises a primary seal adapted to seal between the plug member and the upper portion of the neck, an upper seal adapted to seal between the plug member and the upper portion of the neck, and a nozzle in fluid communication with an external surface of the plug member below the primary seal, wherein the cap member is arranged to be lifted relative to the casing from a closed position, in which the primary seal seals between the plug member and the upper portion of the neck through an open position in which a communication path is provided from the fluid chamber through a path between the upper portion of the neck and the plug member to the nozzle, to a sealed position in which the upper seal seals between the plug member and the upper portion of the neck.

2. A closure device according to claim 1 wherein the cap member and the casing comprise mutually engaging detent means or locking means which engage when the cap member is lifted relative to the casing to the sealed position to prevent further relative movement of the cap member and casing.

3. A closure device according to claim 1 wherein the cap member is provided with a primary engagement means which engages with a corresponding primary engagement means provided on the casing to allow the cap member to be lifted relative to the casing by relative rotation from the closed position through the open position to the sealed position.

4. A closure device according to claim 1 wherein the neck comprises a lower cylindrical portion having a uniform diameter larger than the first diameter of the upper portion.

5. A closure device according to according to claim 1 wherein the plug member comprises a secondary seal adapted to seal between the plug member and the lower portion of the neck.

6. A closure device according to claim 1 wherein the casing includes an inner casing wall adapted to fit inside the container neck of the opening and the closure device include sealing means which is adapted to seal between the container neck and the inner casing wall.

7. A closure device according to claim 1 wherein the plug member is integrally formed with the casing.

8. A closure device according to claim 1 wherein the plug member is formed separately from the casing and is secured to a bottom wall of the casing.

9. A closure device according to claim 5 wherein the plug member includes an internal fluid passage which extends to the external surface of the plug member at a position between the primary seal and the secondary seal, the internal fluid passage being in communication with the nozzle.

10. A closure device according to claim 1 wherein the casing includes a security device which prevents rotation of the cap member and casing relative to the neck of the container until a predetermined torque is applied to the cap member.

11. A container having a main liquid compartment, a container neck, an opening at the container neck and a closure device closing said opening, wherein the closure device comprises a closure device according to claim 1.

12. A method of introducing an additive liquid into a main liquid compartment of a container having a container neck with an opening, the method comprising the steps of:

providing a closure device according to claim 1;

raising the cap member of the closure device and the pressurised fluid chamber defined by said cap member relative to the casing substantially surrounding the third chamber to cause the plug member provided on said casing and extending into a fluid to move downwards relative to the fluid chamber neck provided at a lower end of the fluid chamber, from a closed position in which the primary seal seals between the plug member and an upper portion of the neck having a first diameter, to an open position in which the primary seal is located below the upper portion of the neck and the upper seal is located above the upper portion of the neck;

releasing pressurised additive liquid from said fluid chamber along a communication path through the upper portion of the neck, through an internal fluid passage in the plug member which extends to an external surface of the plug member, through a nozzle in communication with the internal fluid passage, and into said main liquid compartment; and raising the cap member further relative to the casing to a sealed position in which the primary seal is located below the upper portion of the neck and the upper seal seals between the plug member and the upper portion of the neck.

13. The method of claim 12 including the additional step of locking the cap member and the casing together in the sealed position to prevent further relative movement of the cap member and the casing.

14. The method of claim 12 including the additional step of raising the cap member further to remove the cap member and casing from the container.

15. A closure device according to claim 1 wherein in the closed position the primary seal seals between the plug member and the upper portion of the neck, wherein in the open position the primary seal is located below the upper portion of the neck and the upper seal is located above the upper portion of the neck, and wherein in the sealed position the upper seal seals between the plug member and the upper portion of the neck.

* * * * *